US008931320B2

(12) United States Patent
Miyauchi et al.

(10) Patent No.: US 8,931,320 B2
(45) Date of Patent: Jan. 13, 2015

(54) DIMPLE-FORMING BURNISHING TOOL

(75) Inventors: Shinya Miyauchi, Fukuroi (JP); Tetsuya Suzuki, Kikugawa (JP); Masaru Futamura, Kakegawa (JP)

(73) Assignee: Sugino Machine Limited, Toyama (JP)

( * ) Notice: Subject to any disclaimer, the term of this patent is extended or adjusted under 35 U.S.C. 154(b) by 392 days.

(21) Appl. No.: 13/326,968

(22) Filed: Dec. 15, 2011

(65) Prior Publication Data

US 2012/0160005 A1 Jun. 28, 2012

(30) Foreign Application Priority Data

Dec. 27, 2010 (JP) ..... 2010-290191

(51) Int. Cl.

| | |
|---|---|
| ***B21D 17/04*** | (2006.01) |
| ***B21D 1/02*** | (2006.01) |
| ***B21D 3/02*** | (2006.01) |
| ***B21D 1/08*** | (2006.01) |
| ***B21C 37/30*** | (2006.01) |
| ***B24B 39/02*** | (2006.01) |

(52) U.S. Cl.

CPC ..... *B24B 39/023* (2013.01)
USPC ..... 72/75; 72/112; 72/113; 29/90.01

(58) Field of Classification Search

USPC ..... 72/67, 74, 75, 77, 78, 97, 112, 113, 72/120, 122, 123, 126, 199, 208, 209, 224, 72/225, 283, 370.1; 451/462; 29/90.01, 29/90.2, 90.3, 90.5, 90.6, 90.7, 90.1

See application file for complete search history.

(56) References Cited

U.S. PATENT DOCUMENTS

| | | | | |
|---|---|---|---|---|
| 3,934,443 | A * | 1/1976 | Keen | 72/75 |
| 4,527,929 | A * | 7/1985 | Dickinson et al. | 407/1 |
| 4,542,565 | A * | 9/1985 | Berstein et al. | 29/90.01 |

FOREIGN PATENT DOCUMENTS

JP A-2007-301645 11/2007

* cited by examiner

*Primary Examiner* — Shelley Self
*Assistant Examiner* — Gregory Swiatocha
(74) *Attorney, Agent, or Firm* — Oliff PLC

(57) ABSTRACT

A dimple-forming burnishing tool allowing easy adjustment of a dimple shape is provided. The dimple-forming burnishing tool has a mandrel attached on a rear-end side thereof to a processing machine for rotation, and a cylindrical frame rotatably externally fitted on a tip side of the mandrel and holding a rolling element and a pressing element that are driven by rotation of the mandrel, for forming dimples in an inner surface of a workpiece by rotating the mandrel with the frame disposed inside the inner surface of the workpiece. In the dimple-forming burnishing tool, the mandrel includes a dimple adjusting mechanism. The dimple adjusting mechanism includes: a rolling element rotating portion causing the rolling element to rotate without moving in and out radially of the frame; and a pressing element in-and-out rotating portion causing the pressing element to rotate while moving in and out radially of the frame.

12 Claims, 12 Drawing Sheets

ENLARGED SECTION OF ESSENTIAL PARTS ALONG LINE B—B

SECTION ALONG LINE C—C

SECTION ALONG LINE D—D

SECTION ALONG LINE E—E

DIMPLE-FORMING BURNISHING TOOL

BACKGROUND

1. Technical Field

The present invention relates to a burnishing tool, and more particularly, to a dimple-forming burnishing tool.

2. Related Art

Generally, for slide elements (sliders) used under severe conditions of high rotational speed and heat, such as fluid dynamic bearing surfaces typified by engines and hard disk drives, there is known a technology in which, in order to improve the lubricating performance, microgrooves or dimples are formed in a sliding surface to reduce the frictional resistance of the sliding surface. Examples of the known technologies for forming dimples in a sliding surface include technologies using so-called WPC treatment (fine particle shot peening), laser beam machining, barrel polishing, etc.

On the other hand, burnishing is categorized in plastic deformation in which a work surface of a workpiece is crushed and deformed by rotating a hard roller while pressing the hard roller against the workpiece to enhance the surface hardness and surface roughness. Burnishing can greatly improve the durability, wear resistance, and reliability of the sliding surface.

As a tool of burnishing and forming dimples in an inner surface of a workpiece, known is a technique disclosed, for example, in Japanese Published Unexamined Patent Application No. 2007-301645. The dimple-forming burnishing tool disclosed in Japanese Published Unexamined Patent Application No. 2007-301645 includes a mandrel attached to a processing machine for rotation, and a retainer (a frame) externally fitted to the mandrel in a rotatable manner. The retainer rotatably holds plural rollers (rolling elements) and plural balls (pressing elements) in such a manner that the plural rollers and balls can move radially in and out of an outer surface of the retainer. Also, when the mandrel rotates, protrusions formed on an outer surface of the mandrel is brought into engagement with the rollers and the balls, thereby causing the rollers and the balls to roll while vibrating on the inner surface of the workpiece. In this manner, dimples are formed in the inner surface of the workpiece.

According to Japanese Published Unexamined Patent Application No. 2007-301645, however, a problem still exists that adjustment of a dimple shape (such as groove width, groove length, or groove depth) is difficult, due to a polygonal cross-sectional shape of the mandrel, rotation of the mandrel causes the rollers and the balls both to move radially in and out of the outer surface of the retainer at the same time. Specifically, a failure to precisely locate the tool on the inner surface of the workpiece causes a change in the distance that the rollers and the balls move radially in and out at the start of dimple formation. Therefore, stable forming processing becomes impossible, so that adjustment of the dimple shape becomes more difficult. Further, according to the tool disclosed in Japanese Published Unexamined Patent Application No. 2007-301645, a problem also still exists that dimples are redundantly formed in a tool retraction process (or at the time of tool retraction) because the tool diameter is not reduced at the time of retracting the tool after processing the inner surface of the workpiece.

SUMMARY

Accordingly, the present invention has been made in view of the problems described above, and an object of the present invention is to provide a dimple-forming burnishing tool that allows easy adjustment of a dimple shape. In addition, another object of the invention is to provide a dimple-forming burnishing tool that prevents dimple formation during retraction of the tool from the workpiece.

In order to achieve the above-described objects, according to an aspect of the present invention, there is provided a dimple-forming burnishing tool having: a mandrel attached on a rear-end side thereof to a processing machine for rotation; and a cylindrical frame rotatably externally fitted on a tip side of the mandrel and holding a rolling element and a pressing element that are driven by rotation of the mandrel, for forming dimples in an inner surface of a workpiece by rotating the mandrel with the frame disposed inside the inner surface of the workpiece. The mandrel includes a dimple adjusting mechanism. The dimple adjusting mechanism includes: a rolling element rotating portion causing the rolling element to rotate without moving in and out radially of the frame; and a pressing element in-and-out rotating portion causing the pressing element to rotate while moving in and out radially of the frame.

According to the aspect of the present invention, the mandrel includes the dimple adjusting mechanism that is composed of the rolling element rotating portion and the pressing element in-and-out rotating portion. This structure causes the rolling element to rotate without moving in and out radially of the frame, thereby allowing stable burnishing of the inner surface of the workpiece. Further, a desired dimple can be formed by causing the pressing element to rotate while moving in and out radially of the frame. In this manner, according to the aspect of the present invention, even when the mandrel rotates, the rolling element can be prevented from moving in and out radially of the frame along with the pressing element, thereby allowing easier adjustment in the dimple shape (such as groove width, groove length, or groove depth) than the related art.

Here, if the balls are used as plural pressing elements, an advantage is obtained that, in a case where holes or grooves, such as connecting rod oil holes or intersecting holes, are formed in a direction crossing the inner surface of the workpiece, the balls abut or press against edge portions around the oil holes or the like, thereby allowing removal of burrs on the edge portions of the oil holes or the like at the same time. Further, if the rollers are used as plural rolling elements, an advantage is also obtained that the pressing area at the time of the rolling processing can be increased, so that a machined surface with excellent surface roughness can be obtained.

Furthermore, the above-described structure preferably includes the following. The rolling element includes plural rollers and the pressing element includes plural balls. The plural rollers and balls are alternately spaced on the same circumference of the frame. Each roller is arranged with its axis parallel to an axis of the frame. The rollers have a length greater than a diameter of each ball. The mandrel has on the tip side thereof a tapered portion gradually decreasing in diameter toward a tip of the mandrel. The tapered portion has a first area and a second area on an outer surface thereof. The first area serves as the pressing element in-and-out rotating portion. The second area is disposed on both sides of the first area in an axial direction of the mandrel, and serves as the rolling element rotating portion. The first area has plural circumferentially spaced-apart flat portions. The first area has a polygonal cross section, while the second area has a circular cross section. The flat portions have a length greater than the diameter of each ball and smaller than the length of each roller. When the frame is attached to the mandrel, the rollers are brought into contact with the second area without making contact with the flat portions of the first area, while the balls are only brought into contact with the first area.

The first area, serving as the pressing element in-and-out rotating portion of the present invention, has the plural flat portions and the polygonal cross section. If the rollers are only brought into contact with the first area, by the rotation of the mandrel, the rollers are protruded radially of the frame when the rollers are brought into contact with portions between the flat portions of the first area (that is, the portions corresponding to the angles of the polygonal cross section). On the other hand, the rollers are retracted radially of the frame when the rollers are brought into contact with the flat portions (that is, the portions corresponding to the sides of the polygonal cross section). However, in this structure, the rollers are brought into contact with the second area serving as the rolling element rotating portion, without making contact with the flat portions of the first area. Also, the second area is of a tapered shape without any rough areas on its surface. By the rotation of the mandrel, the rollers can be rotated without being influenced by the flat portions formed in the first area. In other words, the rollers of the present invention are brought into contact with the second area without making contact with the flat portions of the first area. Thus, even when the first area includes the flat portions, with the rotation of the mandrel, the rollers can rotate without retracting radially. On the other hand, the balls of the present invention are only brought into contact with the first area. Thus, the bails move in and out radially while rotating with the rotation of the mandrel.

With this structure, therefore, in the dimple formation with the balls, the radial in-and-out movement of the rollers is prevented, thereby easily adjusting the dimple shape. Also, the rollers and the balls can be arranged on the same circumference, thereby allowing a further reduction in size of the tool as compared with a case where the rollers and the balls are separately arranged axially of the frame.

Also, the above-described structure preferably includes the following. The rolling element includes plural rollers and the pressing element includes plural special rollers. The plural rollers and special rollers are alternately spaced on the same circumference of the frame. Each roller and each special roller are both arranged with their respective axes parallel to an axis of the frame. Each of the special rollers has a ring rotating about an axis thereof and a pin holding the ring. The ring has an outer surface of a sharp-pointed shape. The rollers have a length greater than a thickness of the ring. The mandrel has on the tip side thereof a tapered portion gradually decreasing in diameter toward a tip of the mandrel. The tapered portion has a first area and a second area on an outer surface thereof. The first area serves as the pressing element in-and-out rotating portion. The second area is disposed on both sides of the first area in an axial direction of the mandrel and serves as the rolling element rotating portion. The first area has a plurality of circumferentially spaced-apart flat portions. The first area has a polygonal cross section, while the second area has a circular cross section. The flat portions have a length greater than the thickness of the ring and smaller than the length of each roller. When the frame is attached to the mandrel, the rollers are brought into contact with the second area without making contact with the flat portions of the first area, while the ring is only brought into contact with the first area.

The first area, serving as the pressing element in-and-out rotating portion of the present invention, has the plural flat portions and the polygonal cross section. If the rollers are only brought into contact with the first area, by the rotation of the mandrel, the rollers are protruded radially of the frame when the rollers are brought into contact with portions between the flat portions of the first area (that is, the portions corresponding to the angles of the polygonal cross section). On the other hand, the rollers are retracted radially of the frame when the rollers are brought into contact with the flat portions (that is, the portions corresponding to the sides of the polygonal cross section). However, in this structure, the rollers are brought into contact with the second area serving as the rolling element rotating portion, without making contact with the flat portions of the first area. Also, the second area is of a tapered shape without any rough areas on its surface. By the rotation of the mandrel, the rollers can be rotated without being influenced by the flat portions formed in the first area. In other words, the rollers of the present invention are brought into contact with the second area without making contact with the flat portions of the first area. Thus, even when the first area includes the flat portions, with the rotation of the mandrel, the rollers can rotate without retracting radially. On the other hand, the rings of the present invention are only brought into contact with the first area. Thus, the rings move in and out radially while rotating with the rotation of the mandrel.

With this structure, therefore, in the dimple formation with the rings, the radial in-and-out movement of the rollers is prevented, thereby easily adjusting the dimple shape. Also, the rollers and the rings can be on the same circumference, thereby allowing a further reduction in size of the tool as compared with a case where the rollers and the rings are separately arranged axially of the frame. Additionally, in this structure, the ring is used as the pressing element. The ring rotates about the axis and has an outer surface of a sharp-pointed shape, thereby allowing a further reduction in the dimple width as compared with a case where the ball is used as the pressing element.

Moreover, the above-described structure may further include a tool diameter adjusting mechanism for adjusting a tool diameter that is a diameter of a first enveloping circle connecting peripheries of the plural rollers. This structure is convenient because the processing dimension of the inner surface of the workpiece can be adjusted. In addition, preferably, the tool diameter adjusting mechanism includes a mechanism in which, at the time of retracting the dimple-forming burnishing tool from the inner surface of the workpiece, the burnishing tool receives the resistance from the inner surface of the workpiece, thereby relatively moving the frame and the mandrel in the axial direction to automatically reduce the tool diameter. This is because it is possible to prevent redundant dimples from being formed at the time of retracting the dimple-forming burnishing tool from the inner surface of the workpiece.

Also, the above-described structure preferably includes the following. The rolling element includes plural rollers. The plural rollers are spaced from one another on a first circumference of the frame. Each roller is arranged with its axes parallel to an axis of the frame. The pressing element includes plural balls. The plural balls are spaced from one another on a second circumference of the frame. The second circumference is apart axially of the frame from the first circumference. The mandrel gradually decreases in diameter toward a tip thereof. The mandrel has a tapered portion serving as the rolling element rotating portion and a stepped shaft portion lower than the tapered portion. The stepped shaft portion is externally fitted with a retainer. The retainer holds plural rotators that are driven by the rotation of the mandrel and serves as the pressing element in-and-out rotating portion. The retainer holds the plural rotators such that the rotators are spaced from one another on the same circumference of the retainer and such that each of the rotators protrudes partially through an outer surface of the retainer. When the frame is attached to the mandrel, the rollers are brought into contact with the tapered portion, while the balls are brought into contact with the retainer holding the plural rotators.

With this structure, since the tapered portion serving as the rolling element rotating portion has contact with the rollers, the rollers rotate with the rotation of the mandrel, while the rollers are prevented from moving in and out radially. On the other hand, the retainer serving as the pressing element in-and-out rotating portion holds the plural rotators, and the balls are brought into contact with the retainer. Thus, when the retainer rotates to bring the balls into contact with the rotators held by the retainer, the balls is protruded radially of the frame. On the other hand, when the balls are brought into contact with portions in between the rotators held by the retainer, the balls are retracted radially of the frame.

In this manner, with this structure, in the dimple formation with the balls, the radial in-and-out movement of the rollers is prevented, thereby easily adjusting the dimple shape. Also, the roller and the ball are arranged apart axially of the frame from each other (in a longitudinally-displaced manner). Therefore, even in a case where there is a notch in the inner surface of the workpiece, the roller can be brought into contact with the notch. Thus, an advantage is also obtained that the sun-and-planet motion of the frame is maintained, thereby stabilizing the dimple formation.

Additionally, the above-described structure preferably further includes a tool diameter adjusting mechanism and a protrusion amount adjusting mechanism. The tool diameter adjusting mechanism adjusts a tool diameter that is a diameter of a first enveloping circle connecting peripheries of the plurality of rollers. The protrusion amount adjusting mechanism adjusts a protrusion amount that is an amount of a second enveloping circle connecting peripheries of the plurality of balls which protrudes radially of the frame beyond the first enveloping circle. The protrusion amount adjusting mechanism is preferably designed to adjust the protrusion amount to a different value without change in the tool diameter.

This structure is provided with the tool diameter adjusting mechanism, thereby allowing adjustment of the tool diameter to a desired value. Also, the protrusion amount adjusting mechanism adjusts the protrusion amount to a different value without change in the tool diameter, thereby allowing the dimple depth. In other words, with this structure, even when the inner surface of the workplace is the same in finished diameter, dimples having different depths can be formed. Therefore, an optimum dimple shape to meet the conditions of use can be formed. In addition, preferably, the tool diameter adjusting mechanism includes a mechanism in which, at the time of retracting the dimple-forming burnishing tool from the inner surface of the workplace, the burnishing tool receives the resistance from the inner surface of the workpiece, thereby relatively moving the frame and the mandrel in the axial direction to automatically reduce the tool diameter. This is because it is possible to prevent redundant dimples from being formed at the time of retracting the dimple-forming burnishing tool from the inner surface of the workplace.

It should be noted that the protrusion amount described herein refers to the amount of the second enveloping circle connecting the peripheries of the plural balls which protrudes radially of the frame beyond the first enveloping circle connecting the peripheries of the plural rollers. Therefore, obviously, the protrusion amount is determined by (second enveloping circle diameter−first enveloping circle diameter)/2.

Furthermore, in the above-described structure, the tool diameter adjusting mechanism is preferably designed to simultaneously move the plural rollers and balls radially of the frame and adjust the tool diameter without change in the protrusion amount.

With this structure in which the protrusion amount is not changed at the time of adjusting the tool diameter, the diameter of the second enveloping circle connecting the peripheries, of the plural balls decreases with decrease of the tool diameter, while the diameter of the second enveloping circle increases with increase of the tool diameter. Consequently, in a case, as for example where the inner surface of the workpiece is processed by the dimple-forming burnishing tool according to the present invention, as the tool diameter is decreased by the tool diameter adjusting mechanism at the time of returning the burnishing tool to an initial position, the diameter of the second enveloping circle also decreases. Consequently, the redundant dimple formation in the inner surface of the workpiece in the process of returning the burnishing tool is avoided.

Moreover, the above-described structure preferably includes the following. The protrusion amount adjusting mechanism is externally fitted to the stepped shaft portion, and has plural adjustable rings. The plural adjustable rings adjust an axial position of the retainer to a predetermined position. The rotators have an outer surface of a tapered shape gradually decreasing in diameter toward a tip thereof. A diameter of a third enveloping circle connecting peripheries of the plural rotators changes according to the axial position of the retainer. Also, the protrusion amount is adjusted by change of the axial position of the retainer.

With this structure, the protrusion amounts of the balls can be adjusted by easily rearranging the adjustable rings and setting the axial position of the retainer to a predetermined position. More specifically, according to this structure, by changing the axial position of the retainer, the diameter of the third enveloping circle is changed at one position in the axial direction (for example, at a position corresponding to the intersection of a vertical line drawn from a center point of the ball toward a central axis of the retainer and the central axis of the retainer). With a change in the diameter of the third enveloping circle, the engaging position in the radial direction between the ball and the rotator changes. That is to say, the engaging position between the ball and the rotator moves outward in the radial direction (in other words, the radially protruding amount of the ball increases) with increasing diameter of the third enveloping circle. Consequently, the protrusion amounts of the balls can be adjusted by adjusting the axial position of the retainer.

Also, the balls are moved in and out radially by engagement with the rotators, thereby allowing a reduction in a distance that the pressing element is pressed, as compared with the related art structure in which protrusions of the mandrel having the polygonal cross section cause the pressing element to move radially in and out. Therefore, the dimple length can be also reduced.

In addition, preferably, the tapered portion and the rotators have the same taper angle.

With this structure, because the taper angles are the same, when the tool diameter adjusting mechanism adjust the tool diameter, the diameter of the first enveloping circle connecting the peripheries of the plural rollers and the diameter of the second enveloping circle connecting the peripheries of the plural balls increase or decrease by the same value. Consequently, the tool diameter adjustment is facilitated.

According to the present invention, there is provided the dimple adjusting mechanism that allows the only pressing element to move in and out radially of the frame while preventing the rolling element from moving in and out radially of the frame. Thus, the dimple shape can be easily adjusted.

BRIEF DESCRIPTION OF THE DRAWINGS

Embodiments of the present invention will be described in detail based on the following drawings, wherein.

DETAILED DESCRIPTION

Figure 1:
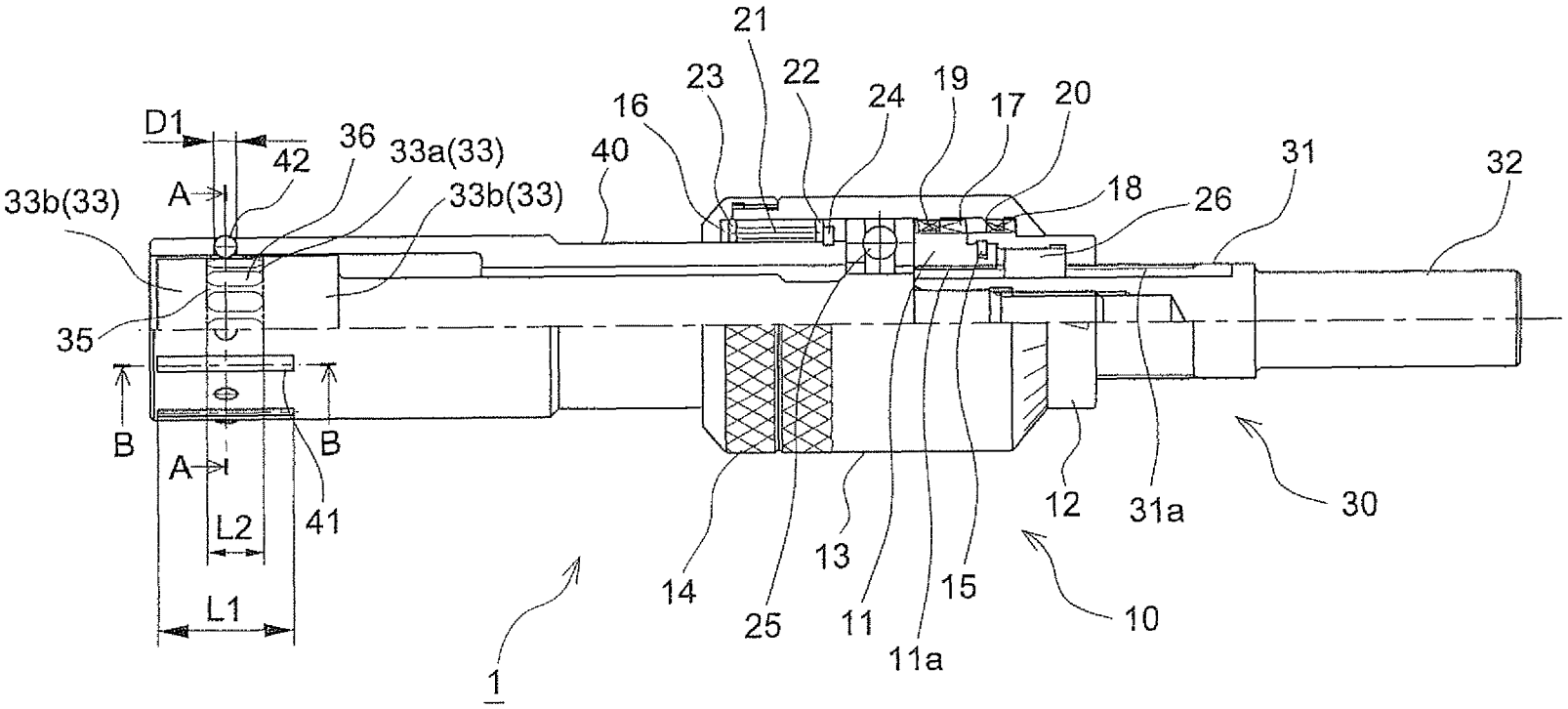
FIG. 1 illustrates, in a partially-sectioned view, the general structure of a dimple-forming burnishing tool according to a first embodiment of the present invention.

Hereinafter, a dimple-forming burnishing tool according to embodiments of the present invention will be described in detail with reference to the accompanying drawings as appropriate. For the sake of convenience, the dimple-forming burnishing tool will be just referred to as "burnishing tool". Firstly, a burnishing tool according to a first embodiment of the present invention will be described with reference to FIGS. 1 to 3. As shown in FIG. 1, the burnishing tool 1 according to the first embodiment is composed of: a mandrel 30 attached to a processing machine, such as a lathe, not shown, for rotation; a frame 40 externally fitted to the mandrel 30; and a tool diameter adjusting mechanism 10 to adjust a tool diameter.

As shown in FIG. 1, the mandrel 30 is generally formed into a round-bar shape. The mandrel 30 has: on a rear-end side thereof a shank 32 attached to a processing machine (not shown), such as a lathe; on a tip side thereof a tapered portion 33; and in a substantially central portion thereof a main body 31. The tapered portion 33 has a tapered shape gradually decreasing in diameter toward the tip thereof (the left side in FIG. 1). The tapered portion 33 includes a first area 33*a* formed in a substantially central portion thereof, and a second area 33*b* formed in front and in the rear (i.e., left and right in FIG. 1) of the first area 33*a* in an axial direction of the mandrel 30.

Figure 2:
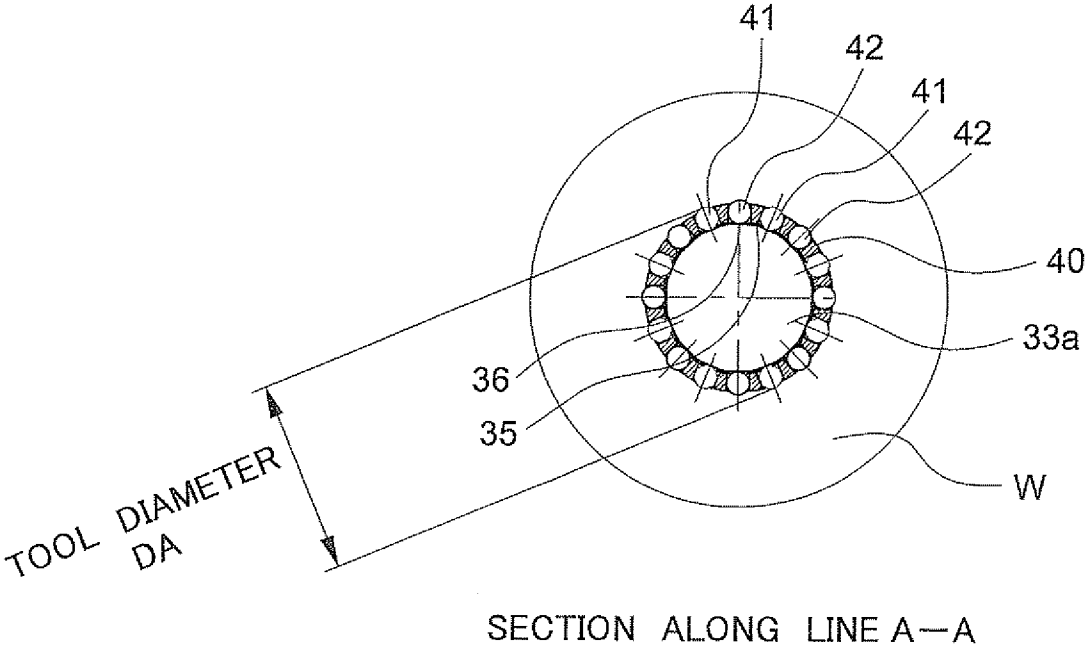
FIG. 2 is a sectional view taken along line A-A of FIG. 1, with the dimple-forming burnishing tool shown in FIG. 1 disposed inside an inner surface of a workpiece.

The second area 33*b* is circular in an arbitrary section and shaped like a circular-truncated cone. The outer surface of the second area 33*b* has no rough areas. On the other hand, the outer surface of the first area 33*a* is formed with plural flat portions 36 each having a flat surface and slightly recessed in an outer surface thereof. More specifically, the sixteen flat portions 36 are closely spaced apart circumferentially of the mandrel 30. Therefore, the portions of the outer surface of the first area 33*a* which corresponds to the flat portions 36 are slightly recessed. Also, the portions in between the flat portions 36 correspond to protrusions 35 protruding slightly through the flat portions 36. Consequently, as shown in FIG. 2, the cross section of the first area 33*a* is of a polygonal shape (namely, a nearly regular hexadecagon) with the protrusions 35 as angles and the flat portions 36 as sides. It should be noted that a surface of slight curvature is formed between the flat portions 36 and the protrusions 35 so as to allow a ball 42 to roll smoothly.

As will be described in more detail later, it should be noted that, when the frame 40 is externally fitted to the mandrel 30, a roller (a rolling element) 41 is disposed in such a manner as to extend across the first area 33*a* and the second areas 33*b* so that the roller 41 is brought into contact with the second areas 33*b* without making contact with the flat portion 36. On the other hand, the ball (the pressing element) 42 is only brought into contact with the first area 33*a*. Also note that the shank 32 may have various shapes, including a tapered shape, of fitting a processing machine to be attached thereto, in addition to a straight shape such as is shown in this embodiment.

Next, the frame 40 is of a cylindrical shape. The frame 40 rotatably holds the plural rollers 41, and also rotatably holds the plural balls 42 in such a manner that the balls 42 can move radially in and out of an outer surface of the frame 40. More specifically, the eight rollers 41 and the eight balls 42 are alternately spaced on the same circumference of the frame 40. It should be noted that the rollers 41 are mounted to the frame 40, with their axes parallel to an axis of the frame 40.

Figure 3:
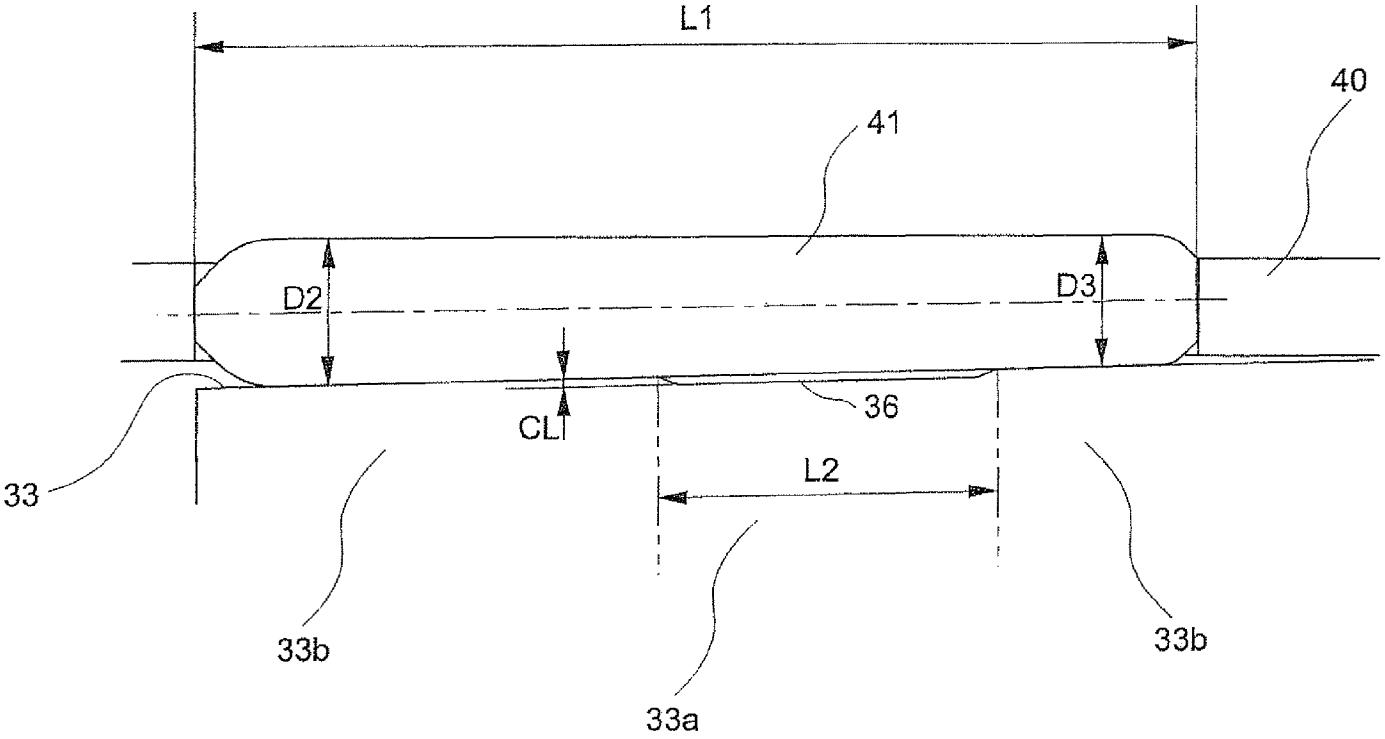
FIG. 3 is an enlarged sectional view of the essential parts taken along line B-B of FIG. 1.

Note that: the length L1 of the roller 41 is larger than diameter D1 of the ball 42; the length L2 of the flat portion 36 is larger than the diameter D1 of the ball 42; and the length L1 of the roller 41 is larger than the length L2 of the flat portion 36. Hence, the relationship of D1<L2<L1 is established. Therefore, as shown in FIG. 3, both ends of the roller 41 are brought into contact with the second areas 33*b*, so that slight clearance CL is made between a substantially central portion of the roller 41 and the flat portion 36. In other words, both end portions of the roller 41 are supported by the second areas 33*b* so that the central portion of the roller 41 is prevented from contact with the surface of the flat portion 36.

It should be noted that the length L1 of the roller 41 is always of such length as to straddle the flat portion 36 even when the relative positions in the axial direction of the mandrel 30 and the frame 40 are changed by the tool diameter adjusting mechanism 10 (described in detail later). That is to say, even if the tool diameter adjusting mechanism 10 is operated, the roller 41 is always prevented from contact with the surface of the flat portion 36. Also, the roller 41 is of a tapered shape gradually slightly decreasing in diameter from one end (the left end in FIG. 3) toward the other end (the right end in FIG. 3). That is, the roller 41 has diameter D2 of the left end slightly larger than diameter D3 of the right end. As for the direction that the roller 41 is mounted to the frame 40, one end (the end having the larger diameter) of the roller 41 corresponds to the tip side of the burnishing tool 1, and the other end (the end having the smaller diameter) corresponds to the rear-end side of the burnishing tool 1.

As shown in FIG. 2, when the burnishing tool 1 is inserted into a workpiece W, the rollers 41 and the balls 42 are interposed between the outer surface of the tapered portion 33 of the mandrel 30 and the inner surface of the workpiece W.

It should be noted that, because the mandrel 30, the rollers 41, the balls 42, and the frame 40 are required to have high durability, special alloy steel is used. The special alloy steel undergoes heat treatment to improve the hardness and tenacity. Also, according to the conditions of use, the surface coating processing, such as DLC, TIN, or TICN, may be performed, thereby allowing further improvement in the durability.

Next, the tool diameter adjusting mechanism 10 is designed to adjust the diameter (diameter DA in FIG. 2) of a first enveloping circle connecting the peripheries of the rollers 41. As shown in FIG. 1, the inside of the tool diameter adjusting mechanism 10, covered with a housing 13, a front cap 14, and a thick adjustable ring 12, is provided with an adjustable nut 11, a key 26, a bearing 25, a spring 21 and the like. The adjustable nut 11 is provided with an internal thread 11*a* to engage a threaded portion 31*a*, and also provided around its periphery with external teeth 17. Also, an abutting surface to abut on the bearing 25 is formed on a front end of the adjustable nut 11. The thick adjustable ring 12 is rotatably and non-removably supported on the adjustable nut 11 by a snap ring 15. The thick adjustable ring 12 is freely fitted to the main body 31 of the mandrel 30 with a predetermined clearance therebetween, and provided on its periphery with external teeth 18 similar to the external teeth 17 of the adjustable nut 11. It should be noted that the thick adjustable ring 12 is restrained by the key 26 from moving circumferentially of the mandrel 30.

The housing 13 is formed in a cylindrical shape. Within the housing 13, there are provided internal teeth 19 and internal teeth 20 which engage the external teeth 17 and the external teeth 18, respectively. Also, the front cap 14 is disposed in front of the housing 13. The spring 21 is interposed between a retaining ring 24 attached to the vicinity of a rear end of the frame 40 and an inner surface of the front cap 14. Note that reference signs 22 and 23 denote spring seats, which are designed to effectively hold the spring 21. Also, reference sign 16 denotes a thrust ring, which is disposed so as to allow the smooth sliding between the spring seat 23 and the front cap 14 when the housing 13 rotates.

In order to adjust the tool diameter with the tool diameter adjusting mechanism 10 constructed in this manner, firstly, the housing 13 is grasped to move the housing 13 rearward against the force of the spring 21. The housing 13 moves with the internal teeth 19 and 20 of the housing 13 in engagement with the external teeth 17 of the adjustable nut 11 and the external teeth 18 of the thick adjustable ring 12, respectively. When the housing 13 further moves, the engagement between the internal teeth 20 and the external teeth 18 is released. In this state, the external teeth 17 remain in engagement with the internal teeth 19 because the internal teeth 19 are provided in wide widths.

And then the housing 13 is rotated while being pressed rearward. The internal teeth 19 and the external teeth 17 remain in engagement. Also, the internal teeth 20, removed from engagement with the external teeth 18, are free to rotate. Therefore, when the housing 13 turns, the housing 13 and the adjustable nut 11 are rotated together, so that the adjustable nut 11 moves forward or rearward along a thread lead with respect to the threaded portion 31*a* of the mandrel 30. At this time, since the adjustable nut 11 and the thick adjustable ring 12 are turnably locked by the snap ring 15, the thick adjustable ring 12 moves along the mandrel 30 with the key 26 as the adjustable nut 11 moves longitudinally while rotating.

The longitudinal movement of the adjustable nut 11 is relatively the equivalent of longitudinally moving the mandrel 30. Therefore, this movement causes the contact position between the tapered portion 33 of the mandrel 30 and the rollers 41 to move to a tip or a base (a rear end) of the burnishing tool 1. Thus, according to changes in diameter of the tapered portion 33, the diameter (the diameter DA in FIG. 2) of the first enveloping circle connecting the peripheries of the rollers 41 changes to a desired value.

After the rollers 41 are set to a desired value, the housing 13 is released to cause the spring 21 previously under compression to expand and force the front cap 14 forward. Thus, the housing 13 is unitarily moved forward, and stopped by abutting the thick adjustable ring 12. In this state, the internal teeth 19 and 20 of the housing 13 are in engagement with the external teeth 17 of the adjustable nut 11 and the external teeth 18 of the thick adjustable ring 12, respectively. Also, the rotation of the thick adjustable ring 12 is prevented by the key 26 and a keyway. Thus, the relative rotation of the housing 13 with respect to the mandrel 30 is avoided. In this manner, the tool diameter adjustment is completed.

Next, processes for forming dimples in the inner surface of the workpiece W will be described using the burnishing tool 1, constructed as described above.

<Adjustment process>

In an adjustment process, firstly, the tool diameter of the rollers 41 is adjusted. More specifically, in order to adjust the tool diameter, the housing 13 is moved to a driving side of the mandrel 30, i.e., the side of the shank 32. Then, since the tool diameter is increased by turning the housing 13 to the right and decreased by turning the housing 13 to the left, the housing 13 is turned to the right or left to set a desired tool diameter. After the housing 13 has been turned to a position corresponding to a desired tool diameter, releasing the housing 13 causes the housing 13 to return to an initial position under the restoring force of the spring 21, and the housing 13 is automatically locked against rotation. Thus, the tool diameter is set. And then tips of the rollers 41 are measured by a micrometer to check whether the tool diameter is properly set.

<Machining process>

In a machining process, firstly, the shank 32 is attached to a processing machine. Then the burnishing tool 1 is moved to a dimple forming location of the inner surface of the workpiece W. It should be noted that the machining length of the workpiece W using the burnishing tool 1 can be arbitrarily set by simply changing the stroke control settings of the processing machine. Next, the processing machine is driven to start the rotation of the mandrel 30. For example, when the mandrel 30 is rotated clockwise as seen from the tip side thereof, each of the rollers 41 rotates counterclockwise (on its axis) along the outer surface of the mandrel 30. At this time, since the workpiece W is fixed, the counterclockwise rotation of the rollers 41 causes the rollers 41 to revolve clockwise around the inner surface of the workpiece W and the outer surface of the tapered portion 33 of the mandrel 30.

As described above, each of the rollers 41 is disposed in contact with the outer surface of the second areas 33*b* in a manner straddling the flat portion 36, thereby preventing the roller 41 from contact with the flat portion 36 of the first area 33*a* in all rotational positions of the mandrel 30. Consequently, although the roller 41 is rotated by the rotation of the mandrel 30, the roller 41 is prevented from moving radially of the frame 40, thereby allowing an operator to stably perform burnishing of the inner surface of the workpiece W with the rollers 41.

On the other hand, as for the balls 42, its movement caused by the rotation of the mandrel 30 is slightly different from the rollers 41. In the same manner as the rollers 41, with the rotation of the mandrel 30, each of the balls 42 revolves clockwise while rotating counterclockwise on its axis along the outer surface of the tapered portion 33 of the mandrel 30. However, when the ball 42 revolves around the mandrel 30 while rotating in a state of being sandwiched between the inner surface of the workpiece W and the outer surface of the tapered portion 33, the ball 42 moves through the flat portions 36 formed on the first area 33*a* and the protrusions 35 alternately. Therefore, the ball 42 rolls along the inner surface of the workpiece W while vibrating radially of the frame 40 due to the differences in height (the clearance CL in FIG. 3) between the flat portions 36 and the protrusions 35. This radial in-and-out movement of the ball 42 forms dimples in the inner surface of the workpiece W.

It should be noted that the first area 33*a*, having the function of causing the balls 42 to rotate while moving in and out radially of the frame 40, corresponds to a pressing element in-and-out rotating portion of the present invention. Also, the second area 33*b*, having the function of causing the rollers 41 to rotate without moving in and out radially of the frame 40, corresponds to a rolling element rotating portion of the present invention. Additionally, the tapered portion 33 having the first area 33*a* and the second area 33*b* corresponds to a dimple adjusting mechanism of the present invention.

<Tool retraction/removal process>

In a tool retraction/removal process, firstly, the burnishing tool 1 is moved out of the inner surface of the workpiece W. At this time, in the burnishing tool 1, the spring 21 is moved into an extended position due to the frictional force (resistance) between the spring 21 and the inner surface of the workpiece W to thereby relatively move the frame 40 forward of the mandrel 30. Then the value of the diameter DA of the first enveloping circle connecting the peripheries of the rollers 41, i.e., the tool diameter, is automatically reduced. Thus, formation of redundant dimples in the process of returning the burnishing tool 1 to an initial position is avoided. Thereafter, when the burnishing tool 1 is returned to the initial position and removed from the processing machine, the dimple formation processes end.

In this manner, in the burnishing tool 1 according to the first embodiment, the rollers 41 are prevented from moving radially of the frame 40, thereby stabilizing the rotational motion in the workpiece W of the rollers 41. Thus, in the dimple formation, a proper dimple shape to meet the conditions of use can be formed simply by adjusting the shape, machining conditions, etc., of the balls 42 as appropriate. As a result, excellent lubricating properties are imparted to the inner surface of the workpiece W.

Also, in the burnishing tool 1 according to the first embodiment, the peening effect can increase the surface hardness of the inner surface of the workpiece W and apply compressive residual stress to the work surface, thereby improving the fatigue strength of the work surface. In addition, with the structure in which the balls 42 are used as pressing elements, in a case as for example where oil holes are formed in a direction crossing the inner surface of the workpiece W, the balls 42 abut or press against edge portions around the oil holes, thereby allowing removal of burrs on the edge portions of the oil holes at the same time.

Furthermore, in the burnishing tool 1 according to the first embodiment, the balls 42 and the rollers 41 can be arranged on the same circumference, thereby allowing a reduction in size of the tool 1.

Next, a burnishing tool 101 according to a second embodiment of the present invention will be described with reference to FIGS. 4 to 7. It is to be noted that the same elements as those of the burnishing tool 1 according to the foregoing first embodiment are designated by the same reference signs, and a description thereof will not be repeated.

Figure 4:
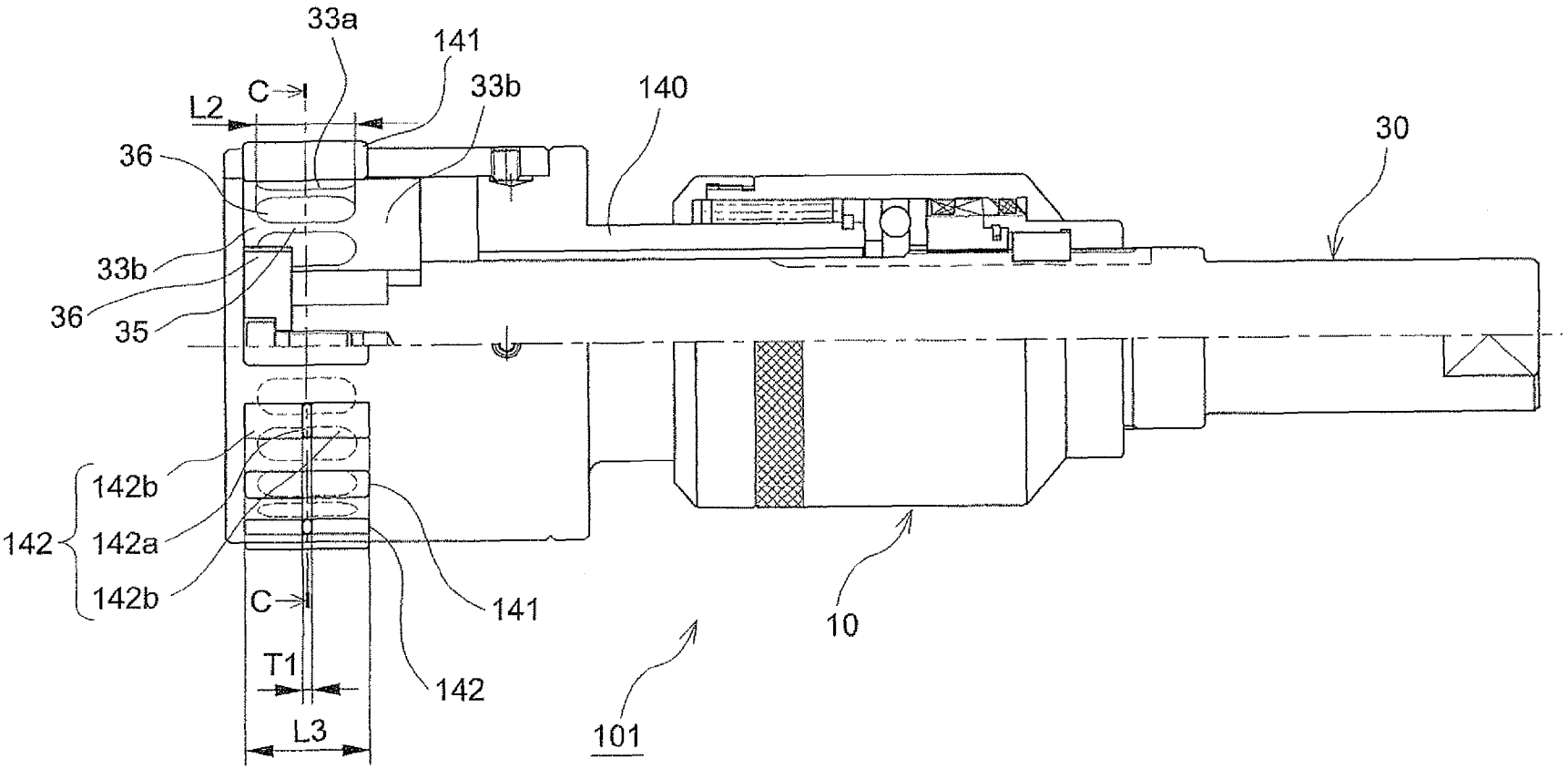
FIG. 4 is illustrates, in a partially-sectioned view, the general structure of a dimple-forming burnishing tool according to a second embodiment of the present invention.
Figure 5:
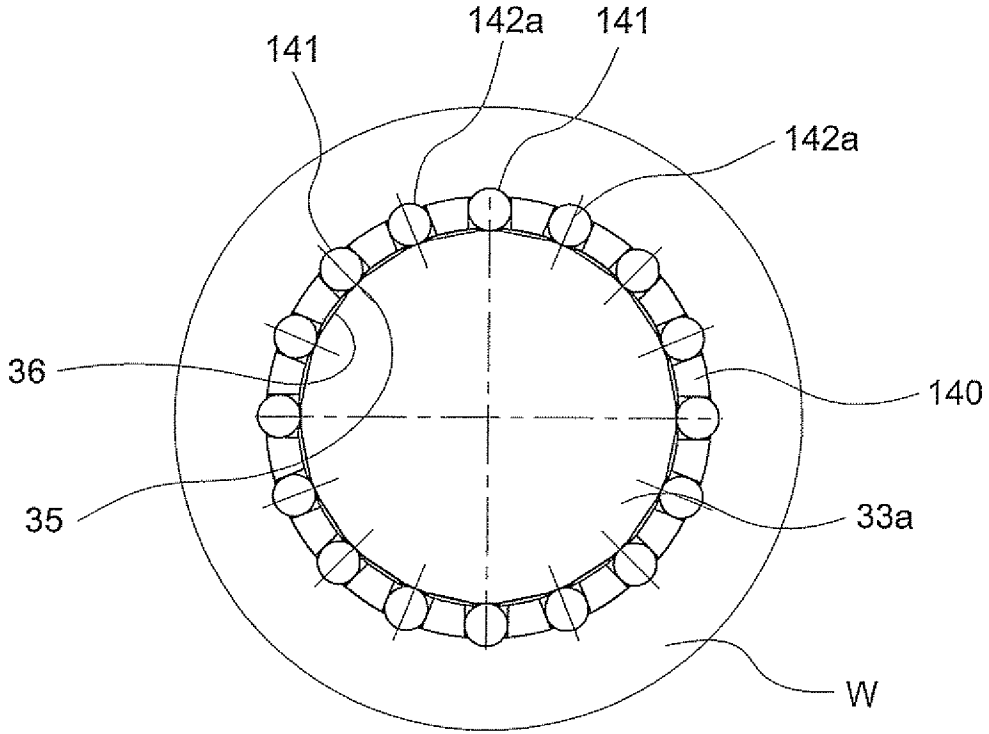
FIG. 5 is a sectional view taken along line C-C of FIG. 4, with the dimple-forming burnishing tool shown in FIG. 4 disposed inside the inner surface of the workpiece.

A major feature of the burnishing tool 101 according to the second embodiment is that special rollers 142 are used as pressing elements in place of the balls 42. As shown in FIG. 4, the burnishing tool 101 is constructed in such a manner that rollers (rolling elements) 141 and the special rollers (pressing elements) 142 are alternately arranged on the same circumference of a cylindrical frame 140. More specifically, as shown in FIG. 5, the eight rollers 141 and the eight special rollers 142, alternately arranged with equal spacing, are rotatably held by the frame 140. Furthermore, the rollers 141 and the special rollers 142 are both directed parallel to an axis of the frame 140. Also, the rollers 141 and the special rollers 142 are both of same length L3.

Figure 6:
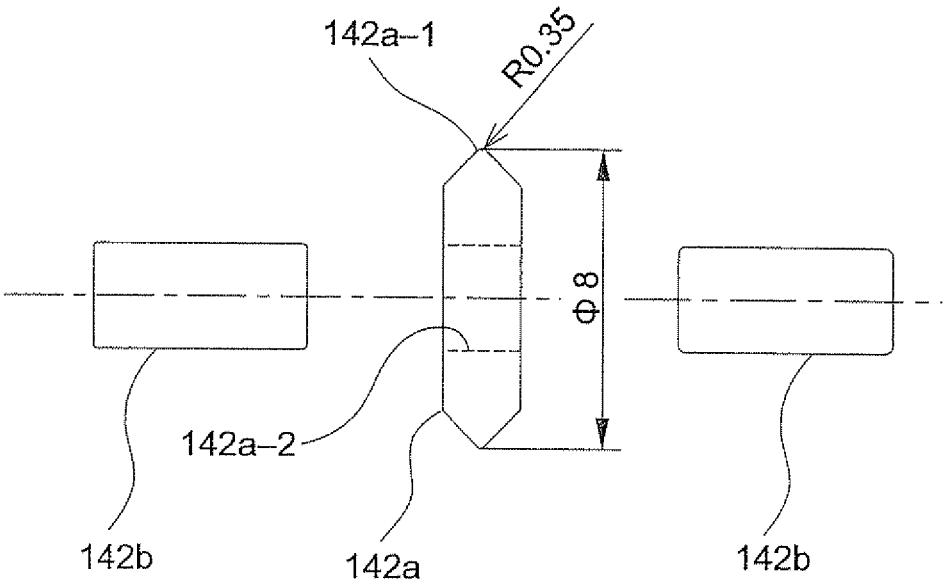
FIG. 6 is a detail view of a special roller shown in FIG. 4.

As shown in FIG. 6, each of the special rollers 142 is composed of a pair of pins 142*b* and a ring 142*a* which are coaxially arranged. The ring 142*a* is supported in such a manner as to be free to rotate about the axis. The ring 142*a* is provided with a through hole 142*a*-2, and has an outer surface of a sharp-pointed shape 142*a*-1. It should be noted that, when the frame 140 is attached to the mandrel 30, the ring 142*a* is disposed in a position corresponding to the first area 33*a* of the mandrel 30. Thus, the ring 142*a* engages the flat portions 36 and the protrusions 35 alternately while rotating with the rotation of the mandrel 30, and thereby moves in and out radially of the frame 140. The radial in-and-out movement of the ring 142*a* forms dimples in the inner surface of the workpiece W.

Note that: thickness T1 of the ring 142*a* is smaller than the length L3 of the roller 141, and smaller than the length L2 of the flat portion 36 formed on the first area 33*a* of the mandrel 30; and the length L3 of the roller 141 is larger than the length L2 of the flat portion 36. Hence, the relationship of T1<L2<L3 is established. Therefore, while not shown in the figure, in the same manner as the first embodiment, both ends of the roller 141 are brought into contact with the second areas 33*b* of the tapered portion 33 of the mandrel 30, so that the slight clearance CL (see FIG. 3) is formed between a substantially central portion of the roller 141 and the flat portion 36. In other words, both ends of the roller 141 are supported by the second areas 33*b* so that the central portion of the roller 141 is prevented from contact with the surface of the flat portion 36. Consequently, although the roller 141 is rotated by the rotation of the mandrel 30, the roller 141 is prevented from moving in and out radially of the frame 140.

It should be noted that the length L3 of the roller 141 is always of such length as to straddle the flat portion 36 even when the relative positions in the axial direction of the mandrel 30 and the frame 140 are changed by the tool diameter adjusting mechanism 10. That is to say, even if the tool diameter adjusting mechanism 10 is operated, the roller 141 is always prevented from contact with the surface of the flat portion 36. Also, the roller 141 is of a tapered shape gradually slightly decreasing in diameter from one end (the left end in FIG. 4) toward the other end (the right end in FIG. 4).

As shown in FIG. 5, when the burnishing tool 101 is inserted into the workpiece W, the rollers 141 and the rings 142*a* are interposed between the outer surface of the tapered portion 33 of the mandrel 30 and the inner surface of the workpiece W.

It should be noted that, because the mandrel 30, the rollers 141, the rings 142*a*, the pins 142*b*, and the frame 140 are required to have high durability, special alloy steel is used. The special alloy steel undergoes heat treatment to improve the hardness and tenacity. Also, according to the conditions of use, the surface coating processing, such as DLC, TIN, or TICN, may be performed, thereby allowing further improvement in the durability.

Figure 7A:
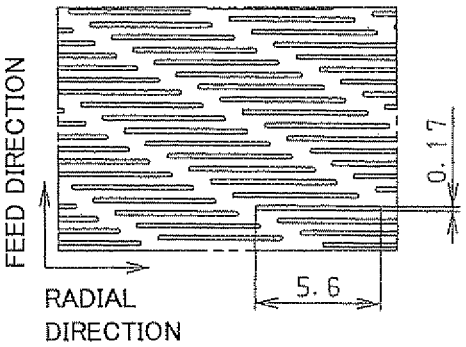
FIGS. 7A and 7B respectively illustrate the shape of dimples formed by the dimple-forming burnishing tool shown in FIG. 4, and the shape of dimples formed by a dimple-forming burnishing tool according to the related art.
Figure 7B:
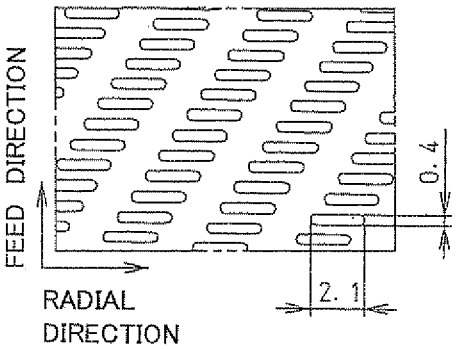

In the burnishing tool 101 constructed in this manner, dimples can be formed by the same processes as the above-described burnishing tool 1. FIG. 7A illustrates the shape of actually-formed dimples. On the other hand, FIG. 7B illustrates the shape of dimples formed by a dimple-forming burnishing tool according to the related art. As is clear from a comparison between FIG. 7A and FIG. 7B, according to the burnishing tool 101, since the sharp-pointed shape 142*a*-1 of the ring 142*a* is pressed against the inner surface of the workpiece W to form dimples, the dimple width can be made smaller than the case in dimple formation using the balls. In other words, simply by employing the rings 142*a*, the dimple width can be suitably adjusted.

Figure 8:
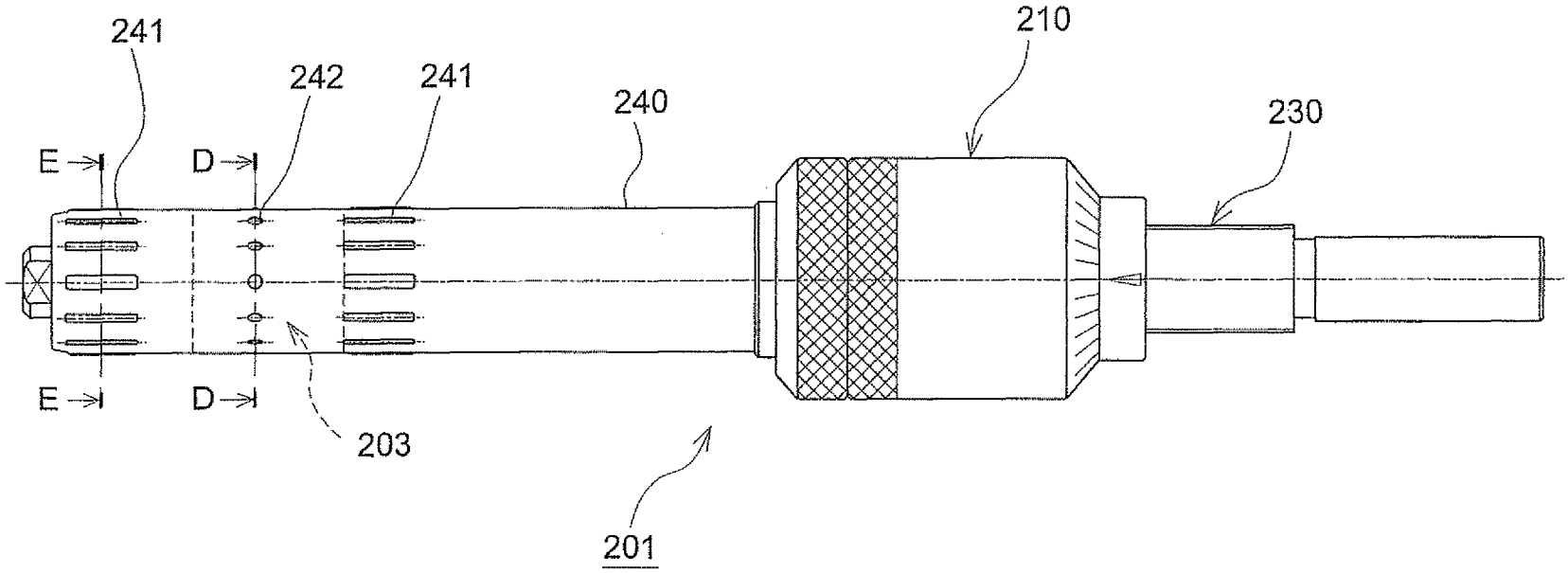
FIG. 8 is a general front view of a dimple-forming burnishing tool according to a third embodiment of the present invention.

Next, a burnishing tool 201 according to a third embodiment of the present invention will be described with reference to FIGS. 8 to 12. As shown in FIG. 8, the burnishing tool 201 according to the third embodiment is composed of: a mandrel 230 attached to a processing machine, such as lathes, not shown, for rotation; a frame 240 externally fitted to the mandrel 230; a tool diameter adjusting mechanism 210 to adjust a tool diameter; and a protrusion amount adjusting mechanism 203 to adjust a protrusion amount. Hereinafter, respective structures of the burnishing tool 201 will be described in detail with reference to FIGS. 9 to 11.

Figure 9:
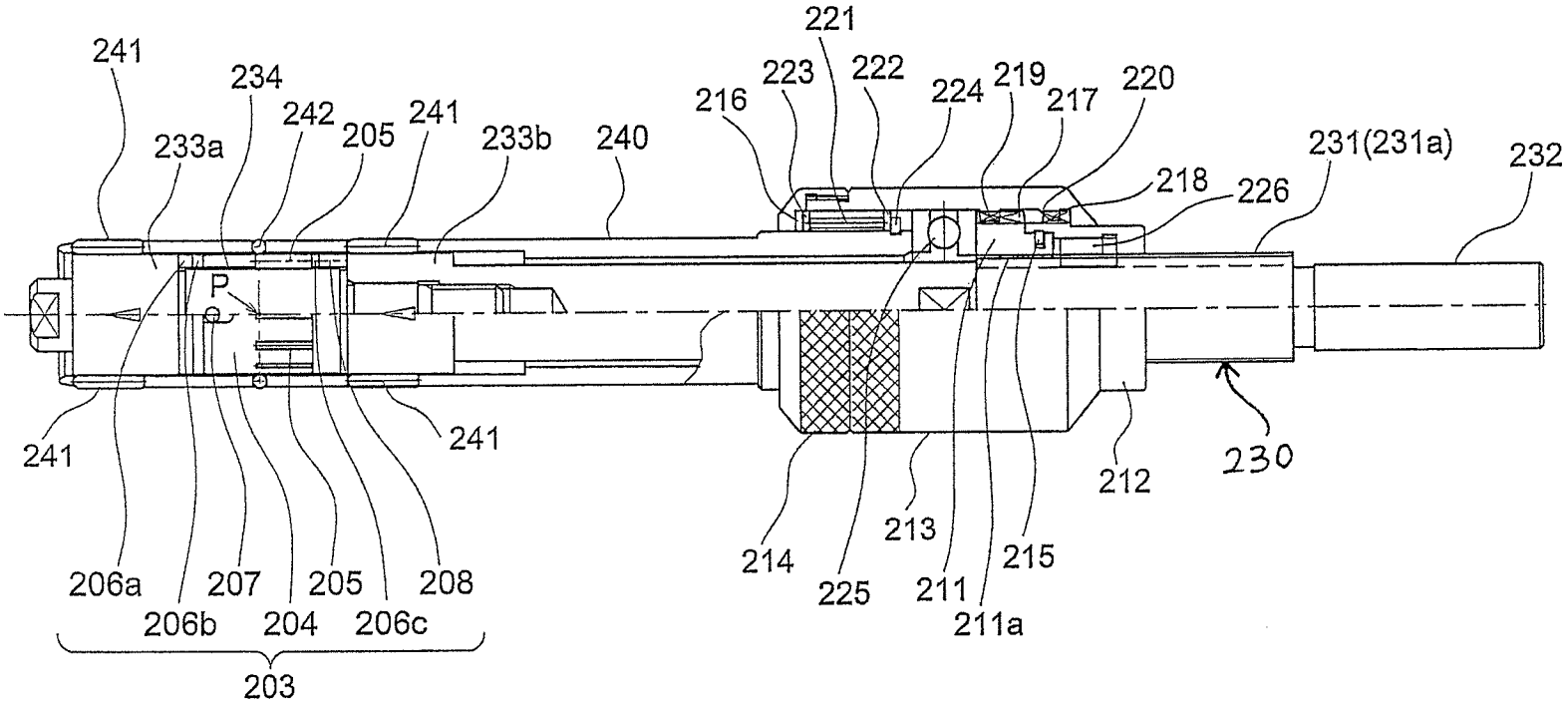
FIG. 9 illustrates, in a partially-sectioned view, the general structure of the dimple-forming burnishing tool shown in FIG. 8.

As shown in FIG. 9, the mandrel 230 is generally formed into a round-bar shape. The mandrel 230 has: on a rear-end side thereof a shank 232 attached to a processing machine (not shown), such as a lathe; on a tip side thereof, a first tapered portion 233*a*, a stepped shaft portion 234, and a second tapered portion 233*b* in that order; and in a substantially central portion thereof a main body 231. The first tapered portion 233*a* and the second tapered portion 233*b* are of the same shape, namely, a tapered shape gradually decreasing in diameter toward a tip thereof. Also, outer surfaces thereof are formed of smooth surfaces without any rough areas.

On the other hand, the stepped shaft portion 234 is of a solid round-bar shape having a diameter smaller than those of the first tapered portion 233*a* and the second tapered portion 233*b*, and forms a stepped portion lower than the first tapered portion 233*a* and the second tapered portion 233*b*. Also, a threaded portion 231*a* is formed in an outer surface of the main body 231, and a keyway to fit a key 226 is provided along an axial direction of the main body 231.

As will be described in more detail later, it should be noted that, when the frame 240 is externally fitted to the mandrel 230, the first tapered portion 233*a* and the second tapered portion 233*b* are disposed in positions corresponding to rollers (rolling elements) 241, while the stepped shaft portion 234 is disposed in a position corresponding to balls (pressing elements) 242. Also, note that the shank 232 may have various shapes, including a tapered shape, capable of fitting a processing machine to be attached thereto, in addition to a straight shape such as is shown in this embodiment.

The frame 240 is of a cylindrical shape. The frame 240 rotatably holds the plural rollers 241 and the plural balls 242. More specifically, the two rollers 241 and the single ball 242 are arranged in a row, spaced apart from one another, in order from the tip side, the roller 241, the ball 242, and the roller 241. This row of the two rollers 241 and the single ball 242 is taken as a pair, and twelve pairs are evenly spaced circumferentially of the frame 240. Also, the roller 241 is of a tapered shape gradually slightly decreasing in diameter from one end toward the other end. As for the direction that the roller 241 is mounted to the frame 240, one end (the end having the larger diameter) of the roller 241 corresponds to the tip side of the burnishing tool 201, and the other end (the end having the smaller diameter) corresponds to the rear-end side of the burnishing tool 201.

Figure 10:
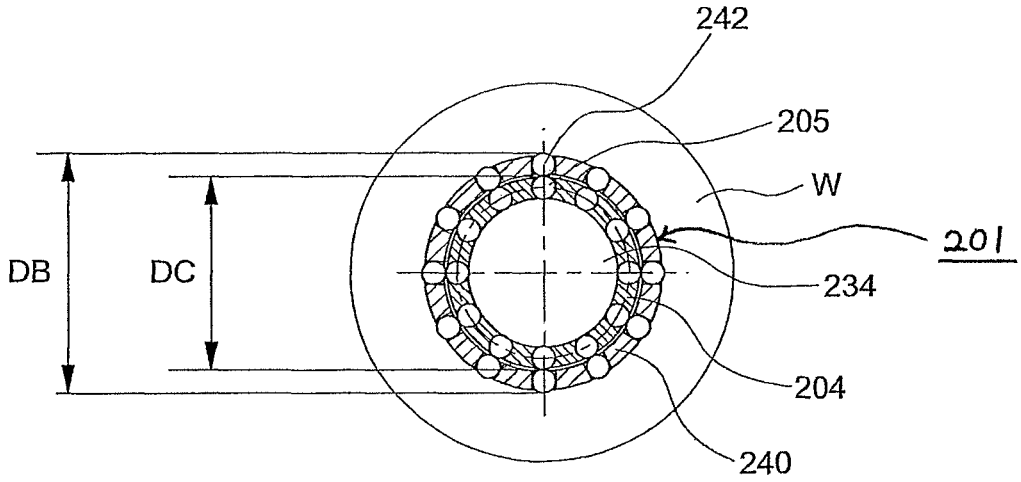
FIG. 10 is a sectional view taken along line D-D of FIG. 8, with the dimple-forming burnishing tool shown in FIG. 8 disposed inside the inner surface of the workpiece.
Figure 11:
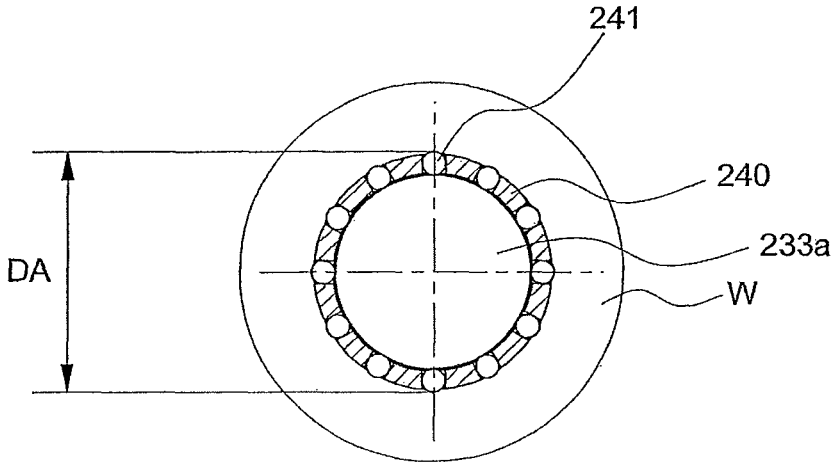
FIG. 11 is a sectional view taken along line E-E of FIG. 8, with the dimple-forming burnishing tool shown in FIG. 8 disposed inside the inner surface of the workpiece.

As shown in FIG. 10, when the burnishing tool 201 is inserted into the workpiece W, the balls 242 are interposed between an outer surface of a retainer 204 (described in detail later) externally fitted to the stepped shaft portion 234 of the mandrel 230 and the inner surface of the workpiece W. Also, as shown in FIG. 11, the rollers 241 are interposed between the outer surface of the first tapered portion 233*a* of the mandrel 230 and the inner surface of the workpiece W. While not shown in the figure, the rollers 241 are interposed between the outer surface of the second tapered portion 233*b* of the mandrel 230 and the inner surface of the workpiece W.

It should be noted that, because the mandrel 230, the rollers 241, the balls 242, and the frame 240 are required to have high durability, special alloy steel is used. The special alloy steel undergoes heat treatment to improve the hardness and tenacity. Also, according to the conditions of use, the surface coating processing, such as DLC, TIN, or TION, may be performed, thereby allowing further improvement in the durability.

Next, the tool diameter adjusting mechanism 210 is designed to adjust the diameter (diameter DA in FIG. 11) of a first enveloping circle connecting the peripheries of the rollers 241. The tool diameter adjusting mechanism 210 is the same as the tool diameter adjusting mechanism 10 mentioned above, i.e. reference numerals 211, 211*a*, 212, 214, 215, 216, 217, 218, 219, 220, 222, 223, 224, and 225 are the same as #11, 11*a*, 12, 14, 15, 16, 17, 18, 19, 20, 22, 23, 24, and 25, respectively. Therefore, the detailed description of the tool diameter adjusting mechanism 210 will not be repeated.

The protrusion amount adjusting mechanism 203 is designed to adjust a protrusion amount, that is, the amount of the diameter of the second enveloping circle connecting the peripheries of the balls 242 which protrudes radially beyond the diameter of the first enveloping circle connecting the peripheries of the rollers 241. As shown in FIGS. 9 and 10, the protrusion amount adjusting mechanism 203 is composed of: the retainer 204 that rotatably holds twelve rotators 205; thin adjustable rings 206*a*, 206*b*, and 206*c* (corresponding to adjustable rings of the present invention) that are designed to adjust an axial position of the retainer 204; a detent pin 207; and a spacer 208.

The retainer 204 is formed of a cylindrical member having a diameter slightly larger than that of the stepped shaft portion 234 of the mandrel 230. The twelve rotators 205 are circumferentially arranged with equal spacing on an outer surface of the retainer 204. Each of the rotators 205 is of a tapered shape gradually decreasing in diameter toward a tip thereof. Thus, when the retainer 204 is axially moved on the stepped shaft portion 234, the diameter (diameter DC in FIG. 10) of a third enveloping circle connecting the peripheries of the rotators 205 changes at position P in FIG. 9. More specifically, when the retainer 204 is moved to the tip side (the left side in FIG. 9) of the burnishing tool 201, the diameter DC at the position P increases. When the retainer 204 is moved to the rear-end side (the right side in FIG. 9) of the burnishing tool 201, on the other hand, the diameter DC at the position P decreases. It should be noted that the position P corresponds to the intersection of a vertical line, drawn from the center point of the ball 242 to the central axis of the retainer 204, and the central axis of the retainer 204.

As is clear from FIG. 10, the rotators 205 held by the retainer 204 are designed to engage the balls 242 held by the frame 240. With this structure, as the diameter DC of the third enveloping circle connecting the peripheries of the rotators 205 increases, the protrusion amounts of the balls 242 that are radially protruded (pushed) by the rotators 205 increase. Thus, the diameter DB of the second enveloping circle connecting the peripheries of the balls 242 increases. On the other hand, since the diameter DA of the first enveloping circle connecting the peripheries of the rollers 241 is unchanged, the difference between the diameter DA and the diameter DB increases with the increase of the diameter DC. In other words, the protrusion amounts of the balls 242 increase. On the contrary, as the diameter DC decreases, the amounts of the balls 242 that are radially pushed by the rotators 205 decrease. Thus, the diameter DB decreases, so that the difference between the diameter DA and the diameter DB decreases. Consequently, the protrusion amounts of the balls 242 decrease. In this manner, the protrusion amounts of the balls 242 are adjusted.

It should be noted that the rotators 205 have the same taper angle as the first tapered portion 233*a* and the second tapered portion 233*b*. For this reason, when the mandrel 230 is axially moved, the diameter DA of the first enveloping circle connecting the peripheries of the rollers 241 and the diameter DB of the second enveloping circle connecting the peripheries of the balls 242 are simultaneously changed by the same value. Also, the retainer 204 is integrally mounted to the stepped shaft portion 234 through the detent pin 207 so that the retainer 204 is rotated within the frame 240 by the rotation of the mandrel 230.

Also, the axial position of the retainer 204 can be changed by changing of mounting positions between the thin adjustable rings 206*a*, 206*b*, and 206*c*. Note that, in this embodiment, the thin adjustable ring 206*a* is ring-width t=1 mm; the thin adjustable ring 206*b*, ring-width t=1.5 mm; and the thin adjustable ring 206*c*, ring-width t=2 mm. For example, when the protrusion amount of the ball 242, i.e., a value determined by (diameter DB−diameter DA)/2, is desired to be 20 μm, the thin adjustable ring 206*a* of t=1 mm is mounted on a rear-end side of the retainer 204, and the remaining thin adjustable rings 206*b* and 206*c* are mounted on a tip side of the retainer 204.

Alternatively, when the protrusion amount of the ball 242 is desired to be 22.5 μm, the thin adjustable ring 206*b* of t=1.5 mm is mounted on the rear-end side of the retainer 204, and the remaining thin adjustable rings 206*a* and 206*c* are mounted on the tip side of the retainer 204. Also, when the protrusion amount of the ball 242 is desired to be 25 μm, the thin adjustable ring 206*c* of t=2 mm is mounted on the rear-end side of the retainer 204, and the remaining thin adjustable rings 206*a* and 206*b* are mounted on the tip side of the retainer 204.

Alternatively, when the protrusion amount of the ball 242 is desired to be 27.5 μm, the thin adjustable ring 206*a* of t=1.0 mm and the thin adjustable ring 206*b* of t=1.5 mm are mounted on the rear-end side of the retainer 204, and the remaining thin adjustable ring 206*c* is mounted on the tip side of the retainer 204. Also, when the protrusion amount of the ball 242 is desired to be 30 μm, the thin adjustable ring 206*a* of t=1.0 mm and the thin adjustable ring 206*c* of t=2 mm are mounted on the rear-end side of the retainer 204, and the remaining thin adjustable ring 206*b* is mounted on the tip side of the retainer 204. Obviously, the number and ring widths of the thin adjustable rings may be set as appropriate depending on required specifications.

Processes for forming dimples in the inner surface of the workplace W will be described using the burnishing tool 201 constructed as described above.

<Adjustment process>

In an adjustment process, firstly, in order to adjust the protrusion amount of the ball 242, the axial position of the retainer 204 is adjusted. More specifically, the thin adjustable rings 206*a*, 206*b*, and 206*c* are appropriately disposed in front and in the rear in the axial direction of the retainer 204 according to a selection of the above-described protrusion amounts of the ball 242, that is, 20 μm, 22.5 μm, 25 μm, 27.5 μm, and 30 μm. By this process, adjustment of the protrusion amount of the ball 242 is completed.

Next, the tool diameter of the rollers 241 is adjusted. More specifically, in order to adjust the tool diameter, the housing 213 is moved to a driving side of the mandrel 230, i.e., the side of the shank 232. Then, since the tool diameter is increased by turning the housing 213 to the right and decreased by turning the housing 213 to the left, the housing 213 is turned to the right or left to set a desired tool diameter. After the housing 213 has been turned to a position corresponding to a desired tool diameter, releasing the housing 213 causes the housing 213 to return to an initial position under the restoring force of the spring 221, and the housing 213 is automatically locked against rotation. Thus, the tool diameter is set. And then tips of the rollers 241 are measured by a micrometer to check whether the tool diameter is properly set.

<Machining process>

In a machining process, firstly, the shank 232 is attached to a processing machine. Then the burnishing tool 201 is moved to a dimple forming location of the inner surface of the workpiece W. It should be noted that the machining length of the workpiece W using the burnishing tool 201 can be arbitrarily set simply by changing the stroke control settings of the processing machine. Next, the processing machine is driven to start the rotation of the mandrel 230. For example, when the mandrel 230 is rotated clockwise as seen from the tip side thereof, each of the rollers 241 rotates counterclockwise (on its axis) along the outer surface of the mandrel 230. At this time, since the workpiece W is fixed, the counterclockwise rotation of the rollers 241 causes the roller 241 to revolve clockwise around the inner surface of the workpiece W and the outer surface of the mandrel 230. At this time, the rollers 241 are prevented from moving in and out radially of the frame 240 because the outer surfaces of the first tapered portion 233*a* and the second tapered portion 233*b* have no rough areas. This allows an operator to stably perform burnishing of the inner surface of the workpiece W with the rollers 241.

On the other hand, as for the balls 242, its movement caused by the rotation of the mandrel 230 is slightly different from the rollers 241. Each of the balls 242 revolves clockwise while rotating counterclockwise on its axis along the outer surface of the retainer 204 (in other words, along the third enveloping circle connecting the peripheries of the rotators 205). When the ball 242 revolves around the mandrel 230 while rotating in a state of being sandwiched between the inner surface of the workpiece W and the outer surface of the retainer 204, the ball 242 moves through the rotators 205 held by the retainer 204 and the outer surface of the retainer 204 alternately. Therefore, the ball 242 rolls along the inner surface of the workpiece W while vibrating radially of the frame 240 due to the differences in height between the outer surface of the retainer 204 and the rotators 205. This radial in-and-out movement of the ball 242 forms dimples in the inner surface of the workpiece W.

It should be noted that the retainer 204 holding the plural rotators 205, which has the function of causing the balls 242 to rotate while moving in and out radially of the frame 240, corresponds to a pressing element in-and-out rotating portion of the present invention. Also, the first tapered portion 233*a* and the second tapered portion 233*b*, having the function of causing the rollers 241 to rotate without moving in and out radially of the frame 240, correspond to a rolling element rotating portion of the present invention. Additionally, a dimple adjusting mechanism of the present invention is made up of the retainer 204 holding the rotators 205, the first tapered portion 233*a*, and the second tapered portion 233*b*.

<Tool retraction/removal process>

In a tool retraction/removal process, firstly, the burnishing tool 201 is moved out of the inner surface of the workpiece W. At this time, in the burnishing tool 201, the spring 221 is moved into an extended position due to the frictional force (resistance) between the spring 221 and the inner surface of the workpiece W to thereby relatively move the frame 240 forward of the mandrel 230. Then the value of the diameter DA of the first enveloping circle connecting the peripheries of the rollers 241, i.e., the tool diameter, is automatically reduced. Thus, formation of redundant dimples in the process of returning the burnishing tool 201 to an initial position is avoided. Thereafter, when the burnishing tool 201 is returned to the initial position and removed from the processing machine, the dimple formation processes end.

Figure 12A:
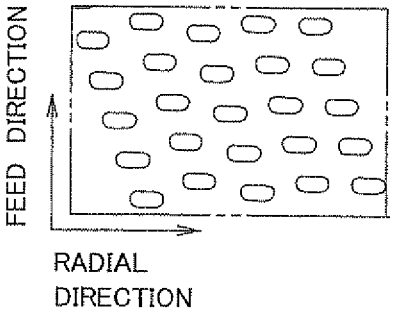
FIGS. 12A and 12B respectively illustrate the shape of dimples formed by the dimple-forming burnishing tool shown in FIG. 8, and the shape of dimples formed by a dimple-forming burnishing tool according to the related art.
Figure 12B:
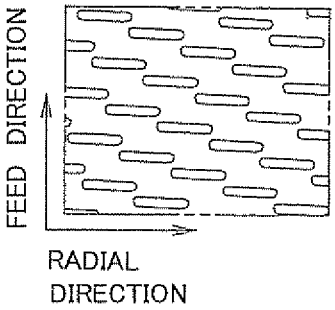

FIG. 12A illustrates the shape of dimples formed in this manner. On the other hand, FIG. 12B illustrates the shape of dimples formed by a burnishing tool according to the related art. As is clear from a comparison between FIGS. 12A and 12B, in the burnishing tool 201 according to the third embodiment, the protrusion amounts of the balls 242 can be adjusted without change in the tool diameter, thereby allowing adjustment of the dimple depth.

That is to say, in the burnishing tool 201 according to the third embodiment, a proper dimple shape to meet the conditions of use can be formed by adjusting the protrusion amounts of the balls 242. As a result, excellent lubricating properties are imparted to the inner surface of the workpiece W.

Also, in the burnishing tool 201 according to the third embodiment, the peening effect can increase the surface hardness of the inner surface of the workpiece W and apply compressive residual stress to the work surface, thereby improving the fatigue strength of the work surface. In addition, with the structure in which the balls 242 are used as pressing elements, in a case as for example where oil holes are formed in a direction crossing the inner surface of the workpiece W, the balls 242 abut or press against edge portions around the oil holes, thereby allowing removal of burrs on the edge portions of the oil holes at the same time.

Furthermore, in the burnishing tool 201 according to the third embodiment, the rollers 241 are provided on the tip side and the rear-end side of the ball 242. Therefore, even in a case, as for example where there is a notch in the inner surface of the workpiece W, at least one of the roller 241 on the tip side and the roller 241 on the rear-end side can be brought into contact with the inner surface of the workpiece W, thereby maintaining the sun-and-planet motion of the frame 240 and enabling the dimple formation.

Figure 13:
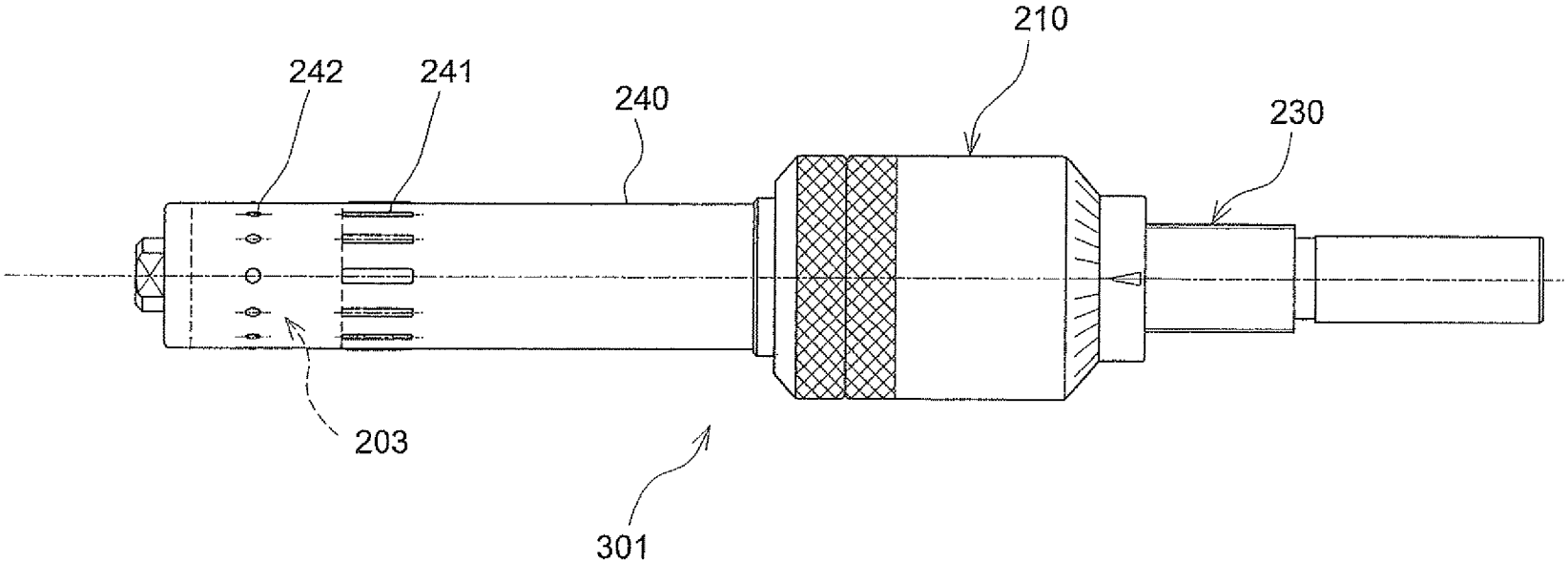
FIG. 13 is a general front view of a dimple-forming burnishing tool according to a first modification.

Next, first and second modifications of the burnishing tool 201 according to the third embodiment will be described. It is to be noted that the same elements as those of the burnishing tool 201 are designated by the same reference signs, and a description thereof will not be repeated. Firstly, FIG. 13 illustrates a burnishing tool 301 according to the first modification. The main feature of the burnishing tool 301 is that the rollers 241 are not provided on the tip side further than the balls 242. Even with this structure, in a case where there is a notch in the inner surface of the workpiece W, the rollers 241 disposed on the rear-end side further than the balls 242 can be brought into contact with the inner surface of the workpiece W, thereby maintaining the sun-and-planet motion of the frame 240 and enabling the dimple formation.

Figure 14:
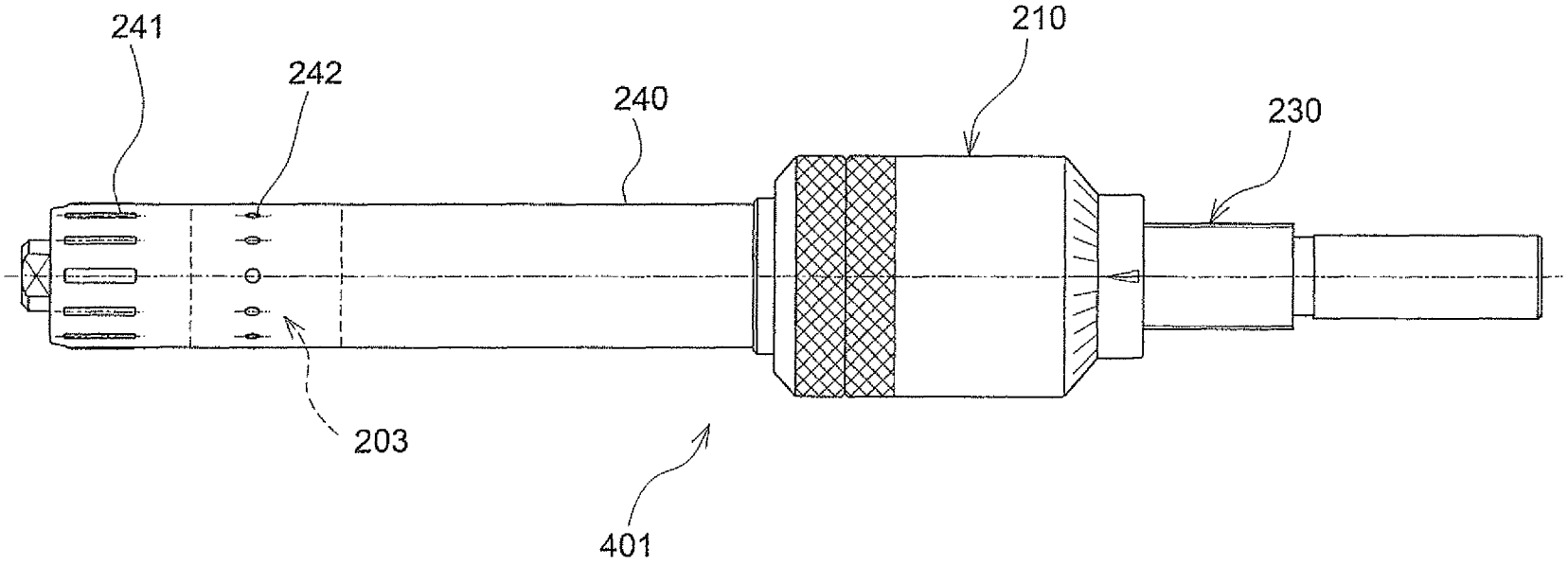
FIG. 14 is a general front view of a dimple-forming burnishing tool according to a second modification.

Also, FIG. 14 illustrates a burnishing tool 401 according to the second modification. The main feature of the second modification is that the rollers 241 are not provided on the rear-end side further than the balls 242. Even with this structure, in a case where there is a notch in the inner surface of the workpiece W, the rollers 241 disposed on the tip side further than the balls 242 can be brought into contact with the inner surface of the workpiece W, thereby maintaining the sun-and-planet motion of the frame 240 and enabling the dimple formation.

Although embodiments and modifications of the present invention have been described above, it should be understood that the invention is not limited to the above-described embodiments and modifications, but may be practiced with various changes.

What is claimed is:

1. A dimple-forming burnishing tool comprising:

a mandrel; and a cylindrical frame rotatably externally fitted on a tip side of the mandrel, the frame holding a rolling element and a pressing element, the rolling element and the pressing element being driven by rotation of the mandrel, for forming dimples in an inner surface of a workpiece by rotating the mandrel with the frame disposed inside the inner surface of the workpiece, wherein:

the mandrel has a dimple adjusting mechanism, the dimple adjusting mechanism including:

a pressing element in-and-out rotating portion causing the pressing element to rotate while moving in and out radially of the frame; and a rolling element rotating portion causing the rolling element to rotate without moving in and out radially of the frame, the rolling element comprises a plurality of rollers and the pressing element comprises a plurality of balls, the plurality of rollers and balls being alternately spaced on the same circumference of the frame, each roller being arranged with its axis parallel to an axis of the frame;

the rollers have a length greater than a diameter of each ball;

the mandrel has on the tip side thereof a tapered portion gradually decreasing in diameter toward a tip of the mandrel;

the tapered portion has a first area and a second area on an outer surface thereof, the first area serving as the pressing element in-and-out rotating portion, the second area being disposed on both sides of the first area in an axial direction of the mandrel, the second area serving as the rolling element rotating portion;

the first area has a plurality of circumferentially spaced-apart flat portions, the first area having a polygonal cross section, while the second area having a circular cross section;

the flat portions have a length greater than the diameter of each ball and smaller than the length of each roller; and when the frame is attached to the mandrel, the rollers are brought into contact with the second area without making contact with the flat portions of the first area, while the balls are only brought into contact with the first area.

2. The dimple-forming burnishing tool according to claim 1, further comprising:

a tool diameter adjusting mechanism, the tool diameter adjusting mechanism adjusting a tool diameter, the tool diameter being a diameter of a first enveloping circle connecting peripheries of the plurality of rollers.

3. A dimple-forming burnishing tool comprising:

a mandrel; and a cylindrical frame rotatably externally fitted on a tip side of the mandrel, the frame holding a rolling element and a pressing element, the rolling element and the pressing element being driven by rotation of the mandrel, for forming dimples in an inner surface of a workpiece by rotating the mandrel with the frame disposed inside the inner surface of the workpiece, wherein:

the mandrel has a dimple adjusting mechanism, the dimple adjusting mechanism including:

a pressing element in-and-out rotating portion causing the pressing element to rotate while moving in and out radially of the frame; and a rolling element rotating portion causing the rolling element to rotate without moving in and out radially of the frame;

the rolling element comprises a plurality of rollers and the pressing element comprises a plurality of special rollers, the plurality of rollers and special rollers being alternately spaced on the same circumference of the frame, each roller and each special roller being both arranged with their respective axes parallel to an axis of the frame;

each of the special rollers has a ring rotating about an axis thereof and a pin holding the ring, the ring having an outer surface of a sharp-pointed shape;

the rollers have a length greater than a thickness of the ring;

the mandrel has on the tip side thereof a tapered portion gradually decreasing in diameter toward a tip of the mandrel;

the tapered portion has a first area and a second area on an outer surface thereof, the first area serving as the pressing element in-and-out rotating portion, the second area being disposed on both sides of the first area in an axial direction of the mandrel, the second area serving as the rolling element rotating portion;

the first area has a plurality of circumferentially spaced-apart flat portions, the first area having a polygonal cross section, while the second area having a circular cross section;

the flat portions have a length greater than the thickness of the ring and smaller than the length of each roller; and when the frame is attached to the mandrel, the rollers are brought into contact with the second area without making contact with the flat portions of the first area, while the ring is only brought into contact with the first area.

4. The dimple-forming burnishing tool according to claim 3, further comprising:

a tool diameter adjusting mechanism, the tool diameter adjusting mechanism adjusting a tool diameter, the tool diameter being a diameter of a first enveloping circle connecting peripheries of the plurality of rollers.

5. A dimple-forming burnishing tool comprising:

a mandrel; and a cylindrical frame rotatably externally fitted on a tip side of the mandrel, the frame holding a rolling element and a pressing element, the rolling element and the pressing element being driven by rotation of the mandrel, for foaming dimples in an inner surface of a workpiece by rotating the mandrel with the frame disposed inside the inner surface of the workpiece, wherein:

the mandrel has a dimple adjusting mechanism, the dimple adjusting mechanism including:

a pressing element in-and-out rotating portion causing the pressing element to rotate while moving in and out radially of the frame; and a rolling element rotating portion causing the rolling element to rotate without moving in and out radially of the frame, the rolling element comprises a plurality of rollers, the plurality of rollers being spaced from one another on a first circumference of the frame, each roller being arranged with its axes parallel to an axis of the frame;

the pressing element comprises a plurality of balls, the plurality of balls being spaced from one another on a second circumference of the frame, the second circumference being apart axially of the frame from the first circumference;

the mandrel gradually decreases in diameter toward a tip thereof, the mandrel having a tapered portion serving as the rolling element rotating portion and a stepped shaft portion lower than the tapered portion;

the stepped shaft portion is externally fitted with a retainer, the retainer holding a plurality of rotators and serving as the pressing element in-and-out rotating portion, the plurality of rotators being driven by the rotation of the mandrel;

the retainer holds the plurality of rotators such that the rotators are spaced from one another on the same circumference of the retainer and such that each of the rotators protrudes partially through an outer surface of the retainer; and when the frame is attached to the mandrel, the rollers are brought into contact with the tapered portion, while the balls are brought into contact with the retainer holding the plurality of rotators.

6. The dimple-forming burnishing tool according to claim 5, further comprising:

a tool diameter adjusting mechanism that adjusts a tool diameter, the tool diameter being a diameter of a first enveloping circle connecting peripheries of the plurality of rollers; and a protrusion amount adjusting mechanism that adjusts a protrusion amount, the protrusion amount being an amount of a second enveloping circle connecting peripheries of the plurality of balls which protrudes radially of the frame beyond the first enveloping circle, wherein the protrusion amount adjusting mechanism adjusts the protrusion amount to a different value without change in the tool diameter.

7. The dimple-forming burnishing tool according to claim 6, wherein: the protrusion amount adjusting mechanism is externally fitted to the stepped shaft portion and has a plurality of adjustable rings, the plurality of adjustable rings adjusting an axial position of the retainer to a predetermined position;

the rotators have an outer surface of a tapered shape gradually decreasing in diameter toward a tip thereof;

a diameter of a third enveloping circle connecting peripheries of the plurality of rotators changes according to the axial position of the retainer; and the protrusion amount is adjusted by change of the axial position of the retainer.

8. The dimple-forming burnishing tool according to claim 7, wherein the tapered portion and the rotators have the same taper angle.

9. The dimple-forming burnishing tool according to claim 6, wherein the tool diameter adjusting mechanism simultaneously moves the plurality of rollers and balls radially of the frame to adjust the tool diameter without change in the protrusion amount.

10. The dimple-forming burnishing tool according to claim 9, wherein: the protrusion amount adjusting mechanism is externally fitted to the stepped shaft portion and has a plurality of adjustable rings, the plurality of adjustable rings adjusting an axial position of the retainer to a predetermined position;

the rotators have an outer surface of a tapered shape gradually decreasing in diameter toward a tip thereof;

a diameter of a third enveloping circle connecting peripheries of the plurality of rotators changes according to the axial position of the retainer; and the protrusion amount is adjusted by change of the axial position of the retainer.

11. The dimple-forming burnishing tool according to claim 10, wherein the tapered portion and the rotators have the same taper angle.

12. A dimple-forming burnishing tool comprising:

a mandrel; and a cylindrical frame rotatably externally fitted on a tip side of the mandrel, the frame holding a rolling element and a pressing element, the rolling element and the pressing element being driven by rotation of the mandrel, for forming dimples in an inner surface of a workpiece by rotating the mandrel with the frame disposed inside the inner surface of the workpiece, wherein:

the mandrel has a dimple adjusting mechanism, the dimple adjusting mechanism including:

a pressing element in-and-out rotating portion causing the pressing element to rotate while moving in and out radially of the frame; and a rolling element rotating portion causing the rolling element to rotate and to be fixed radially to the frame such that the rolling element rotates without moving in and out radially to the frame, and the rolling element comprises a plurality of rollers and the pressing element comprises a plurality of balls, the plurality of rollers and balls being alternately spaced on the same circumference of the frame, and each roller being arranged with its axis parallel to an axis of the frame.

* * * * *